United States Patent [19]

Davis et al.

[11] 3,973,281

[45] Aug. 10, 1976

[54] MOLDED EXPANDED POLYSTYRENE BED ASSEMBLY

[76] Inventors: William R. Davis; Joel T. Davis; William P. Davis, all of Rte. 2, Cave Spring, Ga. 30124

[22] Filed: Dec. 6, 1974

[21] Appl. No.: 530,058

[52] U.S. Cl. ..... 5/131; 5/310; 297/440

[51] Int. Cl.[2] ..... A47C 19/00; A47C 7/00

[58] Field of Search ..... 297/440; 312/256; 5/313 B, 314, 310, 131; 428/314

[56] References Cited

UNITED STATES PATENTS

| | | | |
|---|---|---|---|
| 3,209,380 | 10/1965 | Watsky | 5/347 |
| 3,502,532 | 3/1970 | Frielingsdorf | 428/314 X |
| 3,506,986 | 4/1970 | Lovette | 5/351 X |
| 3,521,311 | 7/1970 | Cohen | 5/36 B X |
| 3,730,109 | 5/1973 | Kriezel | 297/440 X |

*Primary Examiner*—Paul R. Gilliam
*Assistant Examiner*—Andrew M. Calvert
*Attorney, Agent, or Firm*—Newton, Hopkins & Ormsby

[57] ABSTRACT

A bed comprising a platform composed essentially of an expanded polystyrene foam mattress support base or platform upon which a conventional mattress may be supported. The polystyrene foam platform has a panel and an open lattice of flat ribs therebelow with a taut sheet of paper across the bottom.

15 Claims, 5 Drawing Figures

MOLDED EXPANDED POLYSTYRENE BED ASSEMBLY

BACKGROUND OF THE INVENTION

This invention relates to a molded expanded polystyrene bed assembly, and more particularly to a mattress support platform or base for supporting mattresses.

Plastics have heretofore been used as mattress materials. Foamed polyurethane, polyethylene and vinyl, for example, has been so used as disclosed in U.S. Pat. Nos. 3,133,853, 3,210,781 and 3,521,311. Polystyrene has also been used as a mattress material in the form of expanded beads or pellets confined within a flexible cover. In either case these aggregates or pellets provide a relatively soft and flexible structure well suited for cushions and mattresses and one of relatively low cost in comparison with other conventional mattress materials such as those disclosed in U.S. Pat. Nos. 3,608,961 and 3,629,882.

Heretofore, however no mattress support has been provided, consisting essentially of a monolithic or unitary expanded polystyrene structure, the rigidity sufficient to support the weight of a person and the mattress.

Accordingly, it is a general object of the present invention to provide a mattress support for a bed which is inexpensive and yet durable and efficient in use.

More specifically, it is an object of the present invention to provide a bed having a mattress support which is light weight and easily handled yet one which possesses strong load carrying structural strength.

SUMMARY OF THE INVENTION

Briefly described, the present invention, in one embodiment, includes a composite bed having a monolithic or unitary mattress support base or platform formed from molded expanded polystyrene, the support having a unitary, continuous, rectangular, horizontally disposed, upper panel, the side and end edges or perimeter of which is reinforced by an integrally joined, downwardly extending, perimeter frame. The outer dimensions of the perimeter frame correspond to the outer dimensions of the panel so as to merge therewith. Within the frame, there is an open lattice formed of criss-crossed transverse and longitudinal ribs which define, with the frame, a plurality of spaced juxtaposed downwardly opening recesses. The lower edges of the ribs and frame terminate in a common plane parallel to the upper surface of the panel and receive a sheet of paper adhered thereto.

In the first embodiment, molded plastic legs are received in certain of the recesses. In another embodiment a rectangular, wooden or metal reinforcing frame is molded into the support and in a third embodiment, a rectangular bed frame with depending legs removably receives the edge portions of the support, is disclosed.

The support may include a relatively resilient elastomeric pad covering the upper surface of the panel as well as a flexible fabric cover encompassing the sides and top of the support and any pad disposed thereon. The conventional mattress is removably carried by the support.

DETAILED DESCRIPTION OF THE DRAWING

Figure 2:
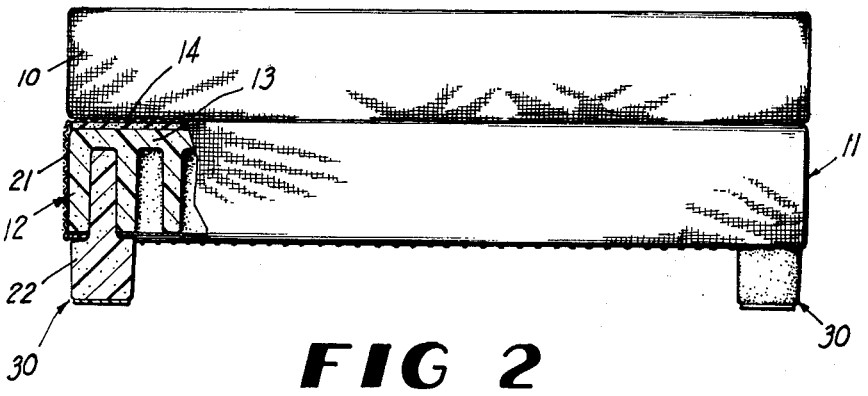
FIG. 2 is a side view in elevation of a bed including the mattress support assembly shown in FIG. 1 with a portion thereof illustrated in cross-section schematically illustrating the composition thereof.

Referring now in detail to the embodiments chosen for the purpose of illustrating the present invention, numeral 10 in FIG. 2 denotes a conventional mattress on which a person sleeps. This mattress 10 may be of any size, i.e., a single mattress, double mattress, king size mattress, queen size mattress, etc. The mattress 10 is supported by the composite mattress support assemby denoted generally by numeral 11.

In more detail, the mattress assemby includes a monolithic or unitary mattress support platform or base 12 formed or composed entirely of molded expanded or low density polystyrene, in a foamed condition. The density of the foamed polystyrene support 12 is from about 0.8 lbs./cubic ft. to about 1.8 lbs./cubic ft.

The support 12 includes a flat, rectangular, upper panel 13 disposed in a horizontal plane. This upper panel 13 has a flat horizontal upper surface 17 and vertically disposed parallel longitudinally extending side edges 19 and transverse end edges 23. If desired, a rectangular, resilient, elastomeric, preferably foamed rubber, removable pad 14 having a thickness of from about 6 inches (preferably 1 inch), may be disposed over surface 17. Pad 14 is usually relatively thin with respect to panel 13 and is of the same rectangular dimensions as panel 13 to cover the same.

Depending from and integrally joined to the bottom edge portions of panel 13 is a rectangular frame 25 corresponding in shape to the rectangular shape of panel 3. The rectangular frame 25 is, therefore, beneath and integrally joined to panel 13, the outer vertical surfaces or edges **19*a* and 23*a* of the frame 25 being respectively disposed in common vertical planes with the edges 19 and 23.**

The rectangular frame 25, thus includes a pair of spaced, rectangular, parallel, longitudinally extending, runners or outer ribs **25*a* the ends of which are joined by spaced, parallel, rectangular transverse runners or outer ribs 25*b*. The height of such rib 25*a* or 25*b* should be, preferably, at least twice its thickness. Ribs 25*a*, 25*b* have flat bottom edges 27*a*, 27*b* which are disposed in a common plane, parallel to top surface 17.**

Inwardly of and between outer longitudinal ribs **25*a*, the support 12 is provided with space, parallel, longitudinally extending, inner longitudinal ribs 16*a*. Ribs 16*a* are disposed on opposite sides of the longitudinal centerline, being respectively inwardly, by an equal distance of, but parallel to the outer ribs 25*a* to provide support under the central portion of panel 13. The ends of ribs 16*a* are integrally joined to the ribs 25*a* at their inner surfaces and integrally joined to panel 13** along its lower surface.

In like fashion, there are a plurality of transverse parallel equally spaced ribs **16*b* inwardly parallel to outer transverse ribs 25*b*. The ribs 16*b* criss-cross the ribs 16***a* to provide an open reinforcing lattice work to support the central portion of panel 13.

The space between ribs 16*a* and ribs 25*a* and between adjacent ribs 16*a* is greater than the space between adjacent ribs 16*b* and adjacent ribs 25*b* and 16*b*. The upper edges of ribs 16*a*, 16*b* are integrally joined to the panel 13 at its lower surface. The lower edges 28*a*, 28*b* of the ribs 16*a*, 16*b* terminate in the common plane of the lower edges 27*a*, 27*b* of ribs 25*a*, 25*b*, parallel to surface 17. Thus, each of the ribs 16*a*, 16*b* is of the same height as a rib 25*a* or 25*b*. They are also of like thickness.

The inner surfaces of ribs 16*a*, 25*a*, 25*b* tapes upwardly, i.e., diverge slightly downwardly at about 1 ½° to about 3° from the vertical so as to define a plurality generally transversely rectangular recesses 15 which open downwardly. Thus, an open lattice structure is provided below continuous panel 13 to provide a rugged yet lightweight monolithic or unitary foamed or expanded polystyrene body 12 which can be produced in an inexpensive mold (not shown) and is readily removable from the mold.

The thickness of panel 13 and ribs 16*a*, 16*b*, 25*a*, 25*b* are approximately equal (about 1 ½ inches) so as to provide for rapid and even cooling of body 12 in the mold to provide a uniform density expandable foamed polystyrene block with a skin of polystyrene covering the exposed surfaces.

It is now seen that the bottom surface formed by edges 27*a*, 27*b*, 28*a*, 28*b* is substantially planar and the bottom portion has a plurality of juxtaposed recesses 15 which open to the exterior of the support body, forming a plurality of coplanar ribs 16*a*, 16*b* which separate the individual recesses 15. A taut rectangular sheet of flexible web material, such as heavy Kraft paper 18, is glued, in a plane, to the bottom surfaces 27*a*, 27*b*, 28*a*, 28*b* and closes the lower open ends of recesses 15.

Figure 3:
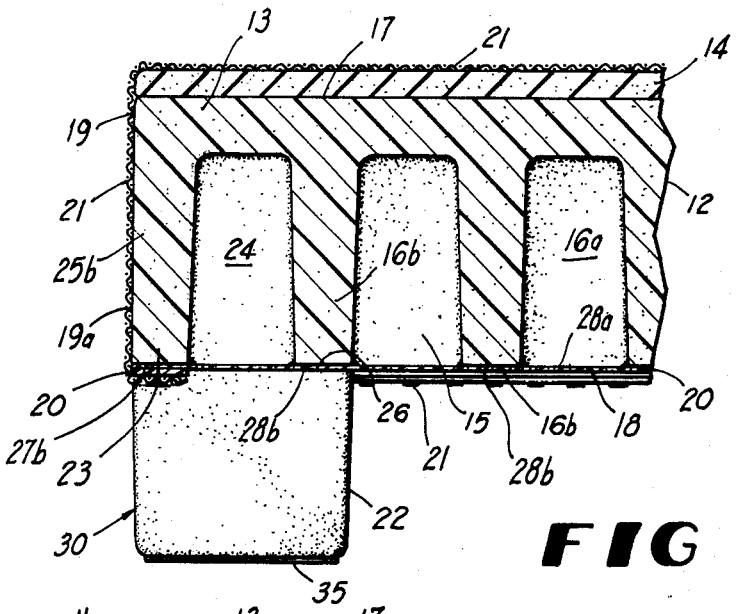
FIG. 3 is an enlarged vertical sectional view of a portion of the mattress support shown in FIG. 2.

The foam rubber pad 14, polystyrene body 12 and sheet 18 of paper are then covered with a fabric, i.e., a cloth cover 21. A thin frame 20 is disposed around the perimeter of paper 18 and the tucked lower edge of cover 21. A plurality of spaced tacks 23 seen in FIG. 3, are driven through the wooden or press boards or plastic rectangular tack frame 20 through the tucked lower edges of the cover 21, and through paper 18, into the bottom of ribs 25*a*, 25*b*, to retain the cover 21 in place. The cover 21 encompasses the side walls, i.e., sides 19, 19*a*, 23, 23*a* and extends over pad 14 and surface 17.

Figure 1:
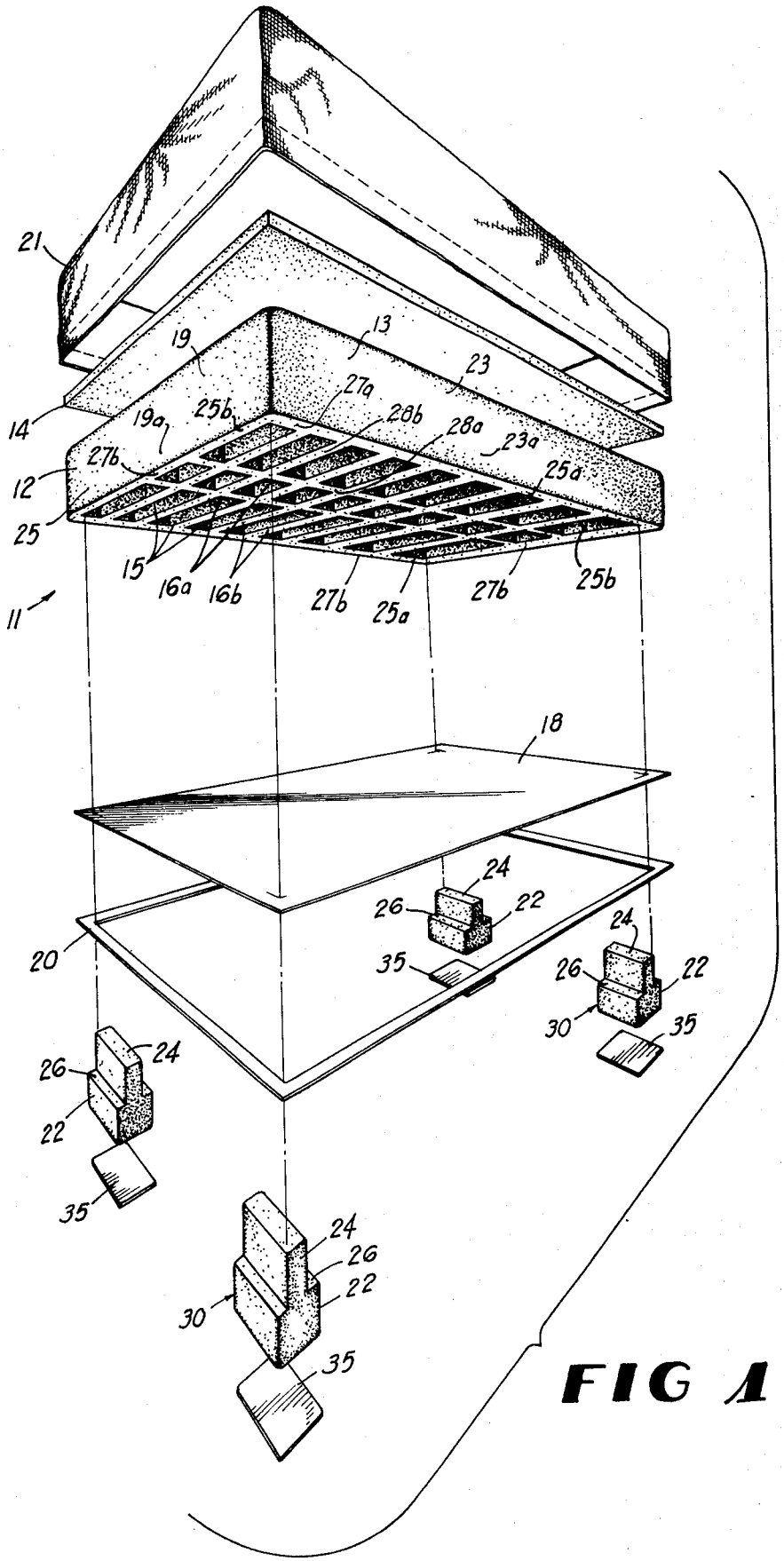
FIG. 1 is an exploded view in perspective of a mattress support assembly embodying principles of the present invention.

The bed seen in FIGS. 1–3, is supported upon a floor by four or more inverted T-shaped hollow, expanded or foamed polystyrene legs 30. Each of legs 30 is mounted to the bed by inserting it upwardly, project its rectangular shank 24 (which conforms to the shape of recess 15) through the corners of paper 18 and into the corner recesses 24 for press fitting engagement with the interior walls of ribs 16*a*, 16*b*, 25*a* and 25*b*. The larger foot 22 is wider than shank 24 limits the inward movement, providing opposite coplanar ledge portions 26 which abut with frame 20 on one side of the extension and rib 16*a* or 16*b* and on the other side thereof. A boot pad 35 used before as frame is on the bottom of each foot 22.

The thin flat struts of frame 20 aid in holding paper 18 against ribs 25*a*, 25*b*. This frame 20 can, if desired, be reinforced by spaced parallel cross struts 21, seen in FIG. 3, the ends thereof being fixed to the sides of frame 20.

Figure 4:
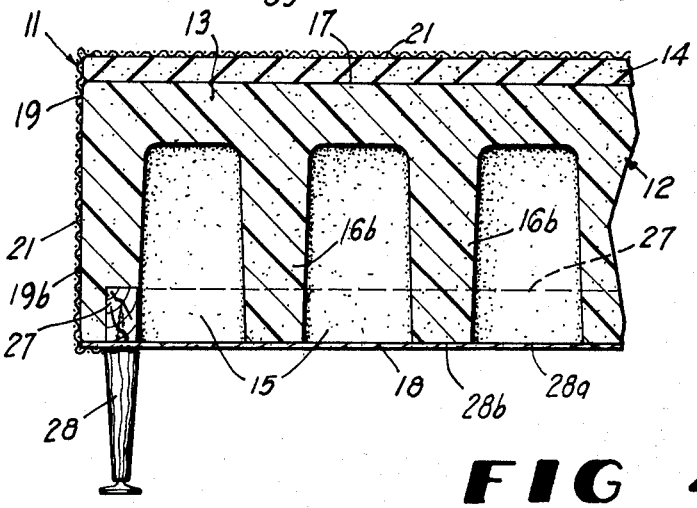
FIG. 4 is another vertical sectional similar to FIG. 3 and showing a portion of a second embodiment of the mattress support assembly shown in FIG. 1 with an alternative bed leg support.

In FIG. 4, an alternative form of the invention is shown, In this embodiment, a leg mounting frame formed preferably of rectangular wooden struts 27 is embedded or molded into the lower inner portions of ribs 25*a*,25*b*. A conventional taper cylindrical leg 28 having a wood screw end is screwed into the strut 27. In some instances, the frame or strut 27 is unnecessary, i.e., blocks of wood used instead, and the legs 28 are screwed directly into the corner portions of support 12.

Figure 5:
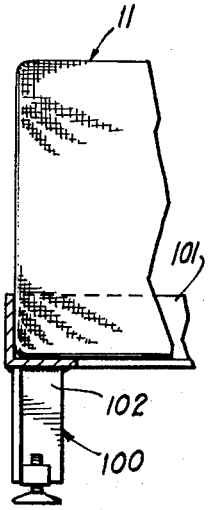
FIG. 5 is a fragmentary side elevational view of the mattress support of FIG. 1 carried by a bed frame.

In FIG. 5 it is seen that, in place of the legs 28 or 30 of FIGS. 1–3 or FIG. 4, the support assembly, denoted by numeral 100 can be supported by conventional wood or metal beds. In FIG. 5 a metal frame with angle iron struts 101 and metal legs 102 supports the support assembly 100 by its lower edges. Transverse slats (not shown) may be employed in frame 100, if desired.

That the mattress support body 12 is composed essentially of molded expanded polystyrene, enabling the bed to be constructed with minimal expense in both material and labor. The resulting structure is light in weight and easily handled in further assembly. Formation of the support 12 is facilitated by the provision of recesses 15 during the body molding process. These recesses 15 provide additional savings in materials cost. If desired, the support 12 can be a solid block, without paper, without recesses. This, of course, is less desirable.

A feature of the invention is the fact that during expansion of the polystyrene to produce foam in the conventional way, an outer skin layer of polystyrene is produced over the entire exposed surfaces. This skin formed along ribs 16*a*, 16*b*, 25*a*, 25*b* enhances the strength of the body 12. The Kraft paper 18 also improves the strength by retarding the tendency of the frame, i.e., ribs 25*a*, 25*b*, to pivot outwardly or split vertically and can be used even with a solid block of expanded polystyrene.

These recesses 15, however, provide additional savings in material cost and production time. The characteristics high density styrene skin which is produced when the hot aluminum mold degases a layer of expandable polystyrene on the surface of a molded part, serves to enhance the normal strength of the material as well as provides the walls within the recess 15 with a greater resistance to the flow of air through the expandable polystyrene walls.

Expandable polystyrene being composed of millions of gaseous cells trapped in surrounding styrene plastic, derives its compression strength from air confined within a space, yet the thin plastic cell walls will tear under tension.

When the ribs 16*a*, 16*b*, 25*a*, 25*b* are sealed with glue to a sheet 20 of medium weight (.069 lb/sq. ft.) Kraft Paper 18 the recesses 15 produce an essentially air tight cavity which will resist compression thus replacing many micro cells with a larger cell. The Paper 18 has a much greater tensile strength than the thin polystyrene plastic cell walls. When placed on the bottom of the foundation body or support 12 the paper 18 resist the tension forces which occur during bending and transfers the compression forces to the rigid styrene plastic cells walls, to the trapped air within the cell walls, and to the trapped air in the recesses 15, the end result being that this expandable polystyrene foundation or support 12, when molded with ribs and glued to paper, is less expensive yet stronger than an equally thick piece of solid expandable polystyrene.

Surprisingly, the assembly 17 meets the requirements for suitable box spring. Destructive tests for a 54 inch span of twin bed size support 12, with paper 18 and/or tack frame 20 when a force was applied transversely at the midsection by a 4 × 4 inches board showed the following:

TABLE I

| Unit Tested | Deflection | Load | Results |
|---|---|---|---|
| Body 12 with paper 18 and tack strip or frame 20 | 2 ⅜" | 339 lbs. | Unit had no collapse or breaking and returned to normal. |
| Body 12 without paper or tack frame 20 | 3" | 284 lbs. | Load created complete break between 3rd & 4th transverse rib. |
| Body 12 without paper 18 or tack frame 20 | 3" | 164 lbs. | Unit broke in half. |

The assembly was further tested by the Cornell test and by the roll test. The body or support 12 was a 3/3 styraform member. The test was conducted with both latex and spring mattresses. In more detail, the tests were as follows:

ROLL TESTS

Unit No. 1

This test was conducted using a 5 inch poly mattress. The box unit or support 12 had been run previously on the Cornell Test and had experienced hairline cracks in the structural beams of about 3 ½ inch. At test's end these cracks had expanded to approximately 4 ½ inch. This was the only deterioration experienced during the test.

Unit no. 2

The second roll test was conducted using a 312 — 13 ½ ga. plus mattress. This box unit or support 12 also had been run previously on the Cornell Test. The unit had not suffered any impairment from the Cornell Test. At roll test's end the box unit 12 had experienced no visible damage. The mattress had encountered 27 broken coils which were all broken at the same location at the knot. There was no helical damage to the mattress.

CORNELL TEST

Test 1

Box unit run with 5 inch poly mattress — Cornell only.

At 25,000 only visible damage is slight depression at test area. Noticed high temperature at point of impact — 212°F to 215°F. At 84,000 two cracks developed in structural beams in bottom. Cracks were about 3 ½ inches long. This appeared to have little influence on remainder of test. Box 12 had approximately ½inch deflection under load throughout test. As rigid as the unit seemed, it still had fair flexing qualities. At the end of test the depression at load point was ¼ to ⅜inch deep. The material at point of impact had hardened from constant compression and heat. There was some surface splitting in the test area but nothing that would take away from the performance of the unit. Data on test are found in Table II.

Test II

Box unit run with plus mattress — 312—13 ga. — 1 inch poly topper — Cornell.

Box 12 had ½inch deflection all through test. There was no visible change in unit's appearance at test's end. At point of impact there was no depression. There was no heat build up at test area. Mattress had no broken parts. Coils at test area took approximately ⅛ to 3/16 inch set.

The unit 12 which was mated with the 5 inch poly matt is in the process of being roll tested. At a constant speed of 56 strokes a minute there appears to be no further elongation of the cracks in the structural beams at 50% of tests completion. Data on tests are found in Table III.

In testing the units in Tests I and II, the brown paper 18 was removed from the bottom to be able to better evaluate the actual workings of the unit. It is thought that this paper should curtail any cracking of the structural beams as it is considered to be an integral part of the unit.

TABLE II

BEDDING TEST DATA

| RUN NO. | 1 | TEST LOAD 230 lbs. 2 | S.P.M. 160 3 | 4 | 5 | TEST LOCATION 6 | 7 | STARTING DATE MATT. NO. BOX SP. NO. 8 | 9 | 10 |
|---|---|---|---|---|---|---|---|---|---|---|
| CYCLES | 00 | 200 | 6000 | 12,500 | 25,000 | 50,000 | 100,000 | | | |
| STROKE, IN. | | 6.0" | 5 7/8" | 5 6/8" | 5 6/8" | 5 7/8" | 5 7/8" | | | |
| INCHES | LBS. | LBS. | LBS. | LBS. | LBS. | LBS. | LBS. | LBS. LBS. | LBS. | |
| 0.0 | 1.0 | 1.0 | 1.0 | 1.0 | 1.0 | 1.0 | 1.0 | | | |
| 1/4 | 4.0 | 4.0 | 1.0 | 4.0 | 4.0 | 4.0 | 3.0 | | | |
| 1/2 | 7.0 | 7.0 | 7.0 | 7.0 | 6.0 | 6.0 | 6.0 | | | |
| 3/4 | 12.0 | 11.0 | 11.0 | 11.0 | 11.0 | 9.0 | 9.0 | | | |
| 1.0 | 16.0 | 14.0 | 15.0 | 15.0 | 14.0 | 14.0 | 12.0 | | | |
| 1.1/4 | 21.0 | 19.0 | 19.0 | 19.0 | 18.0 | 18.0 | 15.0 | | | |
| 1.1/2 | 25.0 | 23.0 | 24.0 | 24.0 | 22.0 | 22.0 | 19.0 | | | |
| 1.3/4 | 29.0 | 27.0 | 27.0 | 27.0 | 25.0 | 26.0 | 23.0 | | | |
| 2.0 | 34.0 | 31.0 | 34.0 | 30.0 | 29.0 | 30.0 | 27.0 | | | |
| 3.0 | 53.0 | 52.0 | 52.0 | 48.0 | 49.0 | 48.0 | 46.0 | | | |
| 4.0 | 78.0 | 76.0 | 77.0 | 78.0 | 74.0 | 76.0 | 73.0 | | | |
| 5.0 | 124.0 | 124.0 | 124.0 | 128.0 | 122.0 | 125.0 | 127.0 | | | |
| 6.0 | 230.0 | | | | | | | | | |
| 7.0 | | | | | | | | | | |
| 8.0 | | | | | | | | | | |
| Stroke at 230 lbs. | 6.0" | 5 7/8" | 5 6/8" | 5 6/8" | 5 7/8" | 5 7/8" | 5 13/16" | | | |
| Dimple, Add'l. Inches (1/16") | | 1/16" | 2/16" | 0 | 0 | 0 | 1/16" | | | |
| ACCUMULATED DIMPLE (1/16") | | 1/16" | 2/16" | 2/16" | 2/16" | 2/16" | | 3/16" | | |
| (A) 5.0" – 4.0" | | 48 lbs. | | (B) 5.0" – 4.0" | | | 54 lbs | % Change | | 12.5 % |

TABLE II-continued

BEDDING TEST DATA

| RUN NO. | 1 | TEST LOAD 230 lbs. 2 | S.P.M. 160 3 | 4 | 5 | TEST LOCATION 6 | 7 | STARTING DATE MATT. NO. BOX SP. NO. 8 | 9 | 10 |
|---|---|---|---|---|---|---|---|---|---|---|
| at 200 cycles | | | | at 100,000 cycles | | | | (A) vs. (B) | | |

At 25,000 extreme heat, depression on box approx. 3/8
At 84,000 temp. 212°F, crack in 2 beams on bottom approx. 3 1/2 long
B/S weighs 9.5 lbs.

TABLE II

BEDDING TEST DATA

| RUN NO. | 1 | TEST LOAD 230 lbs. 2 | S.P.M. 160 3 | 4 | 5 | TEST LOCATION 6 | 7 | STARTING DATE MATT. NO. 8 | 9 | BOX SP. NO. 10 |
|---|---|---|---|---|---|---|---|---|---|---|
| CYCLES | 00 | 200 | 6000 | 12,500 | 25,000 | 50,000 | 100,000 | | | |
| STROKE, IN. | | 5 11/16 | 5 9/16 | 5 1/2 | 5 3/8 | 5 1/4 | 5 1/8 | | | |
| INCHES | LBS. | LBS. | LBS. | LBS. | LBS. | LBS. | LBS. | LBS. | LBS. | LBS. |
| 0.0 | 1.0 | 1.0 | 1.0 | 1.0 | 1.0 | 1.0 | 1.0 | | | |
| 1/4 | 2.0 | 2.0 | 3.0 | 2.0 | 2.0 | 3.0 | 3.0 | | | |
| 1/2 | 5.0 | 6.0 | 5.0 | 5.0 | 5.0 | 6.0 | 6.0 | | | |
| 3/4 | 9.0 | 9.0 | 9.0 | 9.0 | 8.0 | 10.0 | 11.0 | | | |
| 1.0 | 13.0 | 14.0 | 12.0 | 14.0 | 14.0 | 14.0 | 15.0 | | | |
| 1.1/4 | 17.0 | 17.0 | 18.0 | 19.0 | 18.0 | 19.0 | 21.0 | | | |
| 1.1/2 | 24.0 | 24.0 | 23.0 | 24.0 | 23.0 | 27.0 | 26.0 | | | |
| 1.3/4 | 29.0 | 29.0 | 28.0 | 30.0 | 30.0 | 34.0 | 34.0 | | | |
| 2.0 | 36.0 | 37.0 | 36.0 | 37.0 | 38.0 | 42.0 | 42.0 | | | |
| 3.0 | 69.0 | 72.0 | 73.0 | 76.0 | 79.0 | 82.0 | 82.0 | | | |
| 4.0 | 123.0 | 124.0 | 124.0 | 128.0 | 133.0 | 142.0 | 136.0 | | | |
| 5.0 | 186.0 | 188.0 | 190.0 | 198.0 | 212.0 | 221.0 | 213.0 | | | |
| 6.0 | | | | | | | | | | |
| 7.0 | | | | | | | | | | |
| 8.0 | | | | | | | | | | |
| Stroke at 230 lbs. | 5 11/16 | 5 9/16 | 5 1/2 | 5 3/8 | 5 1/4 | 5 1/8 | 5 1/8 | | | |
| Dimple, Add'l. Inches (1/16") | | 4/16" | 2/16" | 2/16" | 4/16" | 2/16" | 0 | | | |
| ACCUMULATED DIMPLE (1/16") | | 4/16" | 6/16" | 8/16" | 12/16" | 14/16" | | | 14/16" | |
| (A) 5.0" – 4.0" at 200 cycles | | 64 lbs. | | (B) 5.0" – 4.0" at 100,000 cycles | | | 77 lbs. | % Change (A) vs. (B) | | 20.3% |

At 100,000 cycles matt. was intact
At 100,000 box intact
Box flex - 1/2"
B/S had no depression at point of impact
Matt. had no broken parts. Coil had between 1/5 & 3/16 set. Very little heat buildup.

Twin unit cost is approximately $6.00. Unit weight 9.5 lbs.

The compressive strength of a 10 × 10 inches body 12 having a density of 1 lb. per cubic foot is 12 lbs. per square inch of surface 17 while the compressive strength of a 1.5 lb. per cubic foot body 12 is 18 lbs. per square inch of surface 17.

Certain maximum and minimum requirements should be observed in obtaining a suitable mattress support assembly. For example, the panel 13 should be from about 1 inch to 2 inches thick and preferably about 1 ½ inches thick. The ribs **16*a*, 16*b*, 25*a*, 25*b* should be from about 1 inch to about 2 inches thick and preferably about 1 ½ inches. The height of the ribs 16*a*, 16*b*, 25*a*, 25*b* should be from about 3 inches to about 8 inches and preferably 5 inches. The space between ribs 16*b*** should be not more than about 3 inches and preferably 2 inches.

The Kraft paper 18 should be from 0.020 lbs. per square foot to 0.090 lbs. per square foot. Of course other flexible strong woven and non-woven fabrics could be substituted for the paper 18. Though the Kraft paper 18 is glued to the ribs bordering the edge of the support it could, if desired, be affixed to the side of the support body or structure 12. In either way the paper 18 tends to prevent the polystyrene structure from buckling or breaking, by inhibiting elongation of the bottom surface of the support as would occur in the case of a structural break in the middle of the structure under loaded conditions.

It should be also noted that the provision of polystyrene legs 30 further enhances cost savings in materials as well as in assembly labor in as much as they may be seated in a very expeditious and simple manner by merely pushing them through small portions of the Kraft paper 18 and into the corner recesses 15.

It should be understood that the just described embodiments merely illustrate principles of the invention in preferred forms. Many modifications may, of course, be made thereto without departure of the spirit and scope of the invention as set forth in the following claims.

We claim:

1. In a bed having a frame and a mattress, a mattress support supporting said mattress and connected to said frame, the improvement comprising said mattress support being composed of a substantially rigid, unitary structure of expanded polystyrene and a reinforcing sheet of web material secured to and extending across the bottom surface of said mattress support.

2. The improvement of claim 1, wherein said unitary structure defines a plurality of downwardly opening recesses in said support, said recesses being covered and closed by said web.

3. A bed accordance with claim 1 wherein said platform has a plurality of recesses opening to said flat bottom surface.

4. A mattress support comprising:

a. a platform composed essentially of substantially rigid, unitary, molded, expanded relatively low density polystyrene, said platform having a relatively high density skin of polystyrene along its exposed surfaces, said platform having an upper surface and a lower surface spaced from each other; and b. a reinforcing web secured to and extending across said lower surface, said web resisting tension forces along said lower surface occuring during bending of said platform.

5. The mattress support defined in claim 4 wherein said web is paper.

6. A mattress support in accordance with claim 2 wherein certain of said recesses have opposed uniformly inwardly tapering surfaces and further comprising legs having their upper portions having uniformly evenly tapering shanks projecting into said certain of said recesses.

7. A bed in accordance with claim 6 wherein said legs are composed essentially of expanded polystyrene.

8. A mattress support in accordance with claim 4, wherein said platform has a substantially flat top surface 4 including a pad of resilient plastic material thereover.

9. A mattress support composed of a monolithic expanded polystyrene structure defining:

a. a rectangular top panel having an essentially planar upper surface;

b. a rectangular support frame below said top panel, said rectangular support frame including a pair of spaced parallel longitudinally extending ribs and a pair of spaced parallel transversely extending ribs joining the ends of said longitudinal ribs, c. an open lattice reinforcing structure within said frame, said lattice structure being integrally joined to the bottom of said panel and the inner surfaces of said ribs; and d. said upper surface being more dense than the interior of said structure.

10. The mattress support defined in claim 4 wherein said interior has a density substantially throughout of from about 0.8 lbs. per cubic foot to about 1.8 lbs. per cubic foot.

11. The mattress support defined in claim 4 wherein said ribs have lower edges lying in a common plane parallel to said top surface and including a sheet of flexible web material secured to said edges for resisting bending of said structure.

12. A mattress support comprising a foamed plastic unitary structure defining:

a. a rectangular top panel having an essentially planar upper surface;

b. a rectangular support frame below said top panel, said rectangular support frame including a pair of spaced parallel longitudinally extending ribs and a pair of spaced parallel transversely extending ribs, and c. an open lattice reinforcing structure within said frame, said lattice structure being integrally joined to the bottom of said panel and the inner surfaces of said ribs, said ribs having lower edges lying in a common plane parallel to said top surface and including a sheet of flexible web material secured to said edges;

d. a second rectangular frame corresponding in shape to said supporting frame, said second frame being secured to the edge portions of said sheet and on the opposite side of said sheet from said support frame.

13. A mattress support comprising a foamed plastic unitary structure defining:

a. a rectangular top panel having an essentially planar upper surface;

b. a rectangular support frame below said top panel, said rectangular support frame including a pair of spaced parallel longitudinally extending ribs and a pair of spaced parallel transversely extending ribs, and c. an open lattice reinforcing structure within said frame, said lattice structure being integrally joined to the bottom of said panel and the inner surfaces of said ribs, said ribs having lower edges lying in a common plane parallel to said top surface and including a sheet of flexible web material secured to said edges;

d. said lattice structure includes transverse and longitudinally extending criss-crossed ribs defining recesses therebetween.

14. A mattress support comprising a foamed plastic unitary structure defining:

a. a rectangular top panel having an essentially planar upper surface;

b. a rectangular support frame below said top panel, said rectangular support frame including a pair of spaced parallel longitudinally extending ribs and a pair of spaced parallel transversely extending ribs, and c. an open lattice reinforcing structure within said frame, said lattice structure being integrally joined to the bottom of said panel and the inner surfaces of said ribs, said ribs having lower edges lying in a common plane parallel to said top surface and including a sheet of flexible web material secured to said edges, said web material is paper.

15. A mattress support comprising a foamed plastic unitary structure defining:

a. a rectangular top panel having an essentially planar upper surface;

b. a rectangular support frame below said top panel, said rectangular support frame including a pair of spaced parallel longitudinally extending ribs and a pair of spaced parallel transversely extending ribs, and c. an open lattice reinforcing structure within said frame, said lattice structure being integrally joined to the bottom of said panel and the inner surfaces of said ribs, said ribs having lower edges lying in a common plane parallel to said top surface and including a sheet of flexible web material secured to said edges, said lattice structure defines a plurality of juxtaposed downwardly opening recesses, the lower open ends of which are closed by said web material.

* * * * *